United States Patent [19]

Bridges

[11] Patent Number: 4,487,737

[45] Date of Patent: Dec. 11, 1984

[54] PULSED NEUTRON GENERATOR CONTROL CIRCUIT

[75] Inventor: James R. Bridges, Houston, Tex.

[73] Assignee: Halliburton Company, Duncan, Okla.

[21] Appl. No.: 342,535

[22] Filed: Jan. 25, 1982

[51] Int. Cl.[3] ..... G21G 4/02

[52] U.S. Cl. ..... 376/119; 376/109

[58] Field of Search ..... 376/119, 109

[56] References Cited

U.S. PATENT DOCUMENTS

| | | | |
|---|---|---|---|
| 2,967,245 | 1/1961 | Soloway | 376/119 |
| 2,994,774 | 8/1961 | Mott | 376/119 |
| 3,176,136 | 3/1965 | Hopkinson | 376/119 |
| 3,719,827 | 3/1973 | Dennis | 376/119 |
| 3,984,694 | 10/1976 | Dennis | 376/119 |
| 4,092,545 | 5/1978 | Langford et al. | 376/119 |
| 4,288,696 | 9/1981 | Peelman et al. | 376/119 |
| 4,404,163 | 9/1983 | Bridges | 376/119 |

*Primary Examiner*—Sal Cangialosi
*Attorney, Agent, or Firm*—W. J. Beard

[57] ABSTRACT

A control and power supply circuit is illustrated in the preferred and illustrated embodiment for providing power to a pulsed neutron generator tube. The preferred and illustrated embodiment includes power supplies and control circuits for providing operative power to the pulsed neutron generator tube. The system monitors the voltages supplied to a downhole sonde utilizing a shut regulator circuit which, with the remainder of the control circuitry set forth, properly and in controlled sequence empowers the pulsed neutron generator tube. The tube is provided with power to switch on and such power is switched off in timed sequence to avoid damaging the tube in the event of a malfunction or loss of power from the surface located power source for the sonde.

6 Claims, 3 Drawing Figures

PULSED NEUTRON GENERATOR CONTROL CIRCUIT

BACKGROUND OF THE DISCLOSURE

Pulsed neutron irradiation is a known technique for logging a wellbore and the strata adjacent to the wellbore. Many type of annalysis can be obtained as a result of pulsed neutron logging.

A pulsed neutron generator tube obtained from Kaman Sciences Corporation of Colorado Springs, Colo. is installed in a sonde for use in downhole conditions. It serves as a source of pulsed neutrons for irradiation of the surrounding formations as the sonde traverses the wellbore. A pulsed neutron tube known as Model A-302A installed in a sonde required reasonably precisely controlled operating voltages and current. In the ordinary circumstance, a sonde is lowered on a multiconductor logging cable. Ordinarily, the AC power source for the system is maintained in the logging truck. The logging truck is normally parked on the surface, and the logging cable that is connected from the truck is spooled on a large storage drum to be fed into the wellbore. The cable is extremely long, and can even reach lengths as great as up to 30,000 feet. Of necessity, the cable must be longer than the depth of the well. The logging cable is ordinarily a multistrand cable encased within a sheath for protection.

The logging cable appears as a long line to an AC input, and therefore has an AC impedance interposed between the AC generator on the truck and the sonde which is supported by the cable. In part, this is aggravated as the pulsed neutron generator tube is switched from idle to 100% output. Such wide variations in current demand by the equipment in the sonde inevitably produces a wide fluctuation in input voltage at the sonde as a result of the impedance imposed between the sonde and the truck located generator. The variations are not minor; the variations can range as high as 40% in an extra long cable at full load conditions.

The present apparatus takes into account line voltage fluctuations in conjunction with the sequence of events required to power the pulsed neutron generator for logging operations. The sequence of events involves the supportive supply circuitry for the neutron generator tube.

This disclosure therefore sets forth an unobvious interlock system which enables stabilized operation of the neutron generator over a logging run under stabilized conditions. Consistency for its operation is assured by the disclosed apparatus. Moreover, the apparatus is able to test for and determine adequate terminal voltage at the sonde to power up the equipment, control the switch-on procedure, initiate a switch-off procedure as necessary and to also protect the neutron generator tube in the event of circuit malfunction. The procedure involved between switching on, switching off and protection in the event of a malfunction is implemented by the circuit means of this disclosure. It thus enables the apparatus to apply a relatively high voltage DC level to the target high voltage power supply driver circuit, also apply a 3,800 hertz, 6 microsecond pulse and a logic zero control signal to the same circuit. This increases the target high voltage power supply output to about 70 kilovolts. An additional operational step achieved on measuring the current drain to the high voltage power supply driver circuit is the formation of a 3,000 volt ion source pulse train and a replenisher current of about 2 amperes. As the pulled neutron generator tube emits neutrons which is indicated by measuring the target current at the low side of the target high voltage power supply, a logic one is applied to the control voltage for the target high voltage power supply driver circuit. This provides the target with the high voltage, nominally 100 kilovolts. In the event of malfunction, the ion source pulses are turned off. The replenisher current (approximately 2 amperes during full load) is reduced substantially to zero, and the target high voltage is reduced from about 100 kilovolts to about 70 kilovolts. These protective steps prevent damage in the event of loss of adequate terminal voltage at the sonde.

One advantage of the present apparatus is the feature which checks terminal voltage at the sonde to verify that the proper voltage level has been furnished. In the event the voltage level is improper, the equipment does not initiate operation of the neutron generator. Rather, it will not start and thereby avoids damage, namely the risk of damage to the expensive tube. While neutron generator tubes can be replaced, it is not an easy procedure to carry out in the field. The neutron generator tube is a relatively expensive device and is protected.

The present invention may therefore be summarized as a pulsed neutron generator tube control circuit capable of monitoring the line voltage applied to it for initiating the turn-on sequence of the components for operation of the generator tube. The apparatus includes an interlock arrangement whereby successful turn-on of the various signals is observed to carry out the various steps providing adequate power to the pulsed neutron generator tube. Moreover, the equipment controls a procedure for switching off, the procedure having a sequence which prevents damage to the generator tube.

BRIEF DESCRIPTION OF THE DRAWINGS

So that the manner in which the above recited features, advantages and objects of the invention, as well as others, which will become apparent, are attained and can be understood in detail, a more particular description of the invention, briefly summarized above, may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

DETAILED DESCRIPTION OF THE PREFERRED EMBODIMENT

Figure 1:
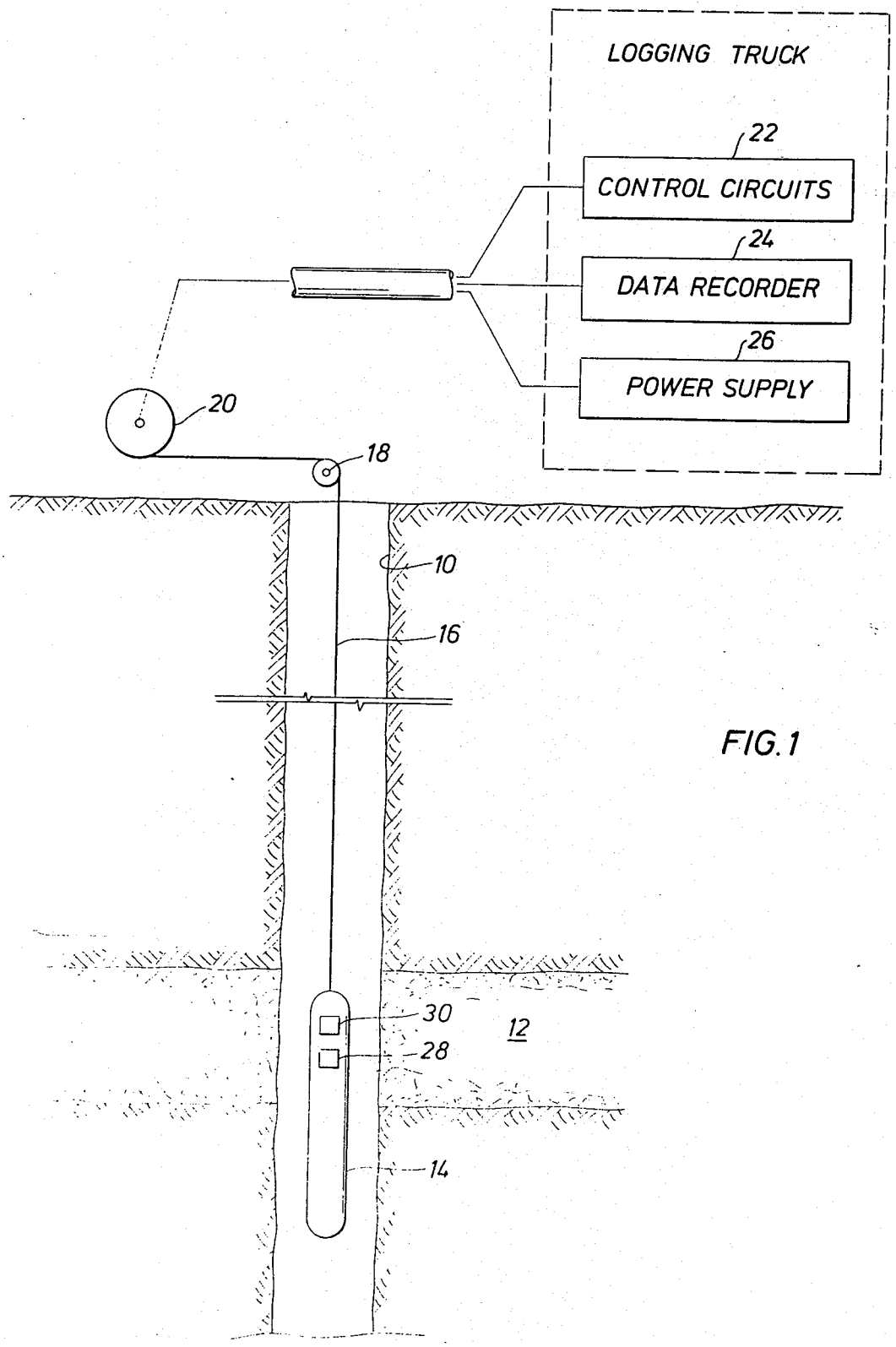
FIG. 1 shows a sonde suspended in a wellbore which encloses a pulsed neutron generator tube for logging purposes which is powered by the control circuit of the present invention.

Attention is first directed to FIG. 1 of the drawings. FIG. 1 sets out the context of the use of the present invention. FIG. 1 shows a wellbore 10 which has been drilled in the earth through multiple formations including the strata 12. The depth of the wellbore 10 is subject to variation over a very wide range. A sonde 14 is suspended in the wellbore supported on a logging cable 16. The logging cable typically includes several conductors and is enclosed by a sheath to withstand the rigors of its use. The logging cable is fairly long. It extends from the sonde 14 over a sheave 18. It is spooled onto a drum 20. The full length of cable is routinely stored on the drum when not in use. It is extended over the sheave 18 to lower the sonde 14 into the wellbore. One important parameter of the cable is the fact that it must be quite long, and cable lengths of up to 30,000 feet have been known. Inevitably, the cable must be longer than the wellbore. One end of the cable is shown in FIG. 1. The upper end of the cable that emerges from the drum 20 is input to a logging truck. The various conductors in the cable are further shown in FIG. 1 to be connected to various and sundry components in the logging truck. One of the devices is the control circuits 22. The cable also includes conductors which are connected with a data recorder 24. In addition, the cable is connected with a power supply 26 to furnish power for the sonde 14. Typically, the power supply is an AC generator. It is connected to a pair of conductors in the cable extending to the sonde 14.

The power source 26 is connected to the sonde through a pair of conductors. The conductors resemble a long line to conduct AC power to the sonde. A long line is characterized by having a characteristic impedance. This impedance interposes a drop at the output. This depends, in part, on parameters of the system including the characteristic impedance of the long line, the frequency of the power source, the relative length of the line and the load placed on the long line. Needless to say, these factors can vary and create a significant drop at the sonde. This problem creates real difficulties in properly powering the equipment within the sonde, and in particular, a pulsed neutron generator system identified by the numeral 28. The sonde additionally supports a cooperative radiation sensor 30 which responds to irradiation of the formation 12 by the pulsed neutron generator system 28. The manner of operation of the sensor 30 is believed to be well known.

AC POWER DELIVERY

Figure 2A:
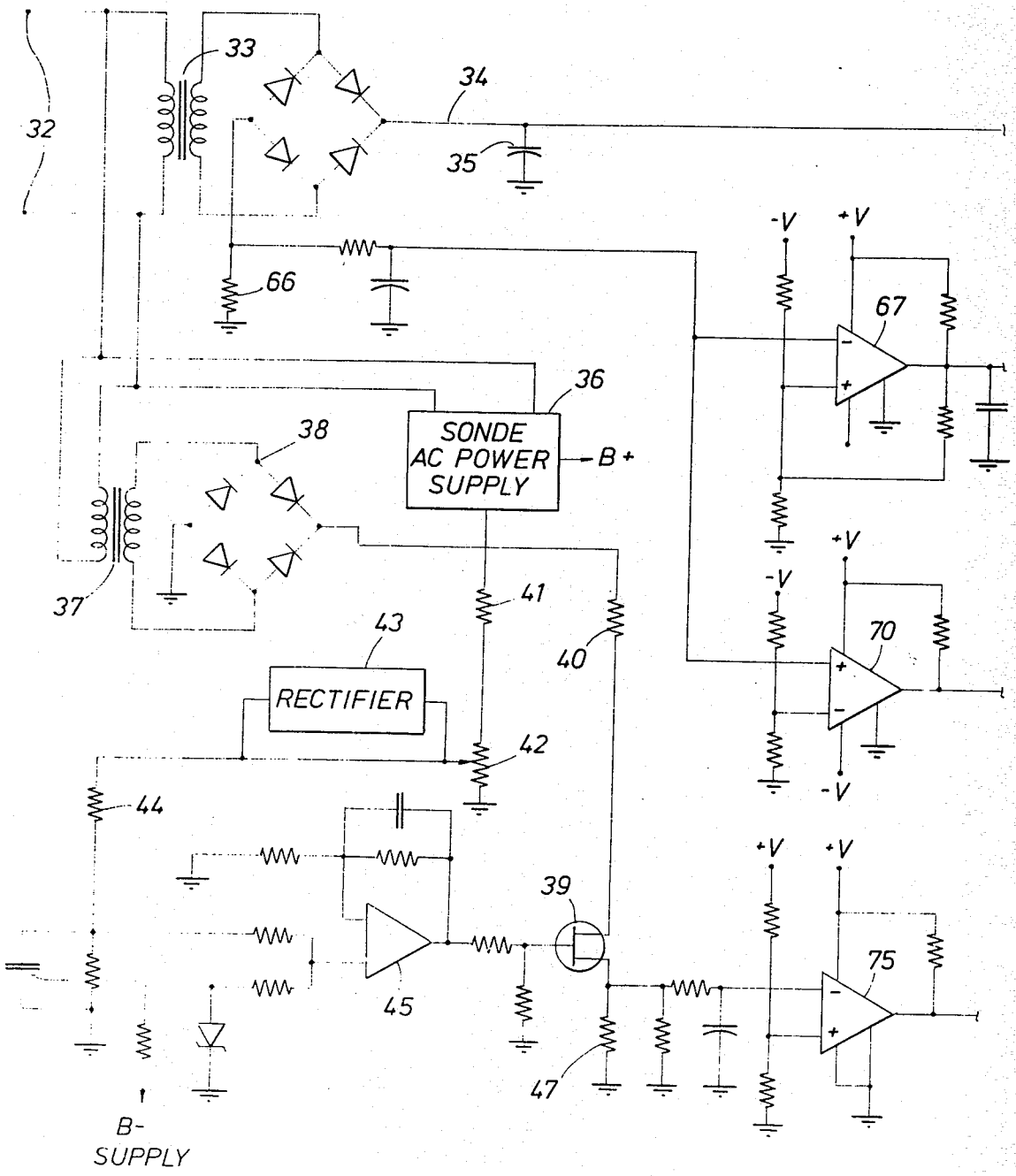
FIGS. 2A and 2B are a schematic wiring diagram of the control circuit of the present invention.
Figure 2A:
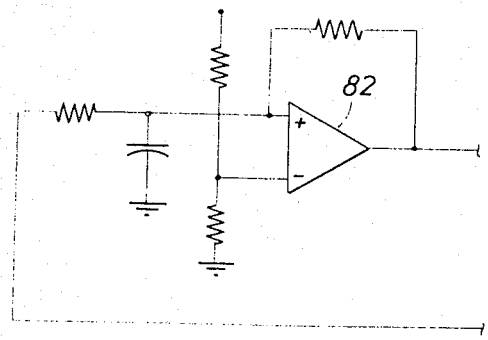
Figure 2B:
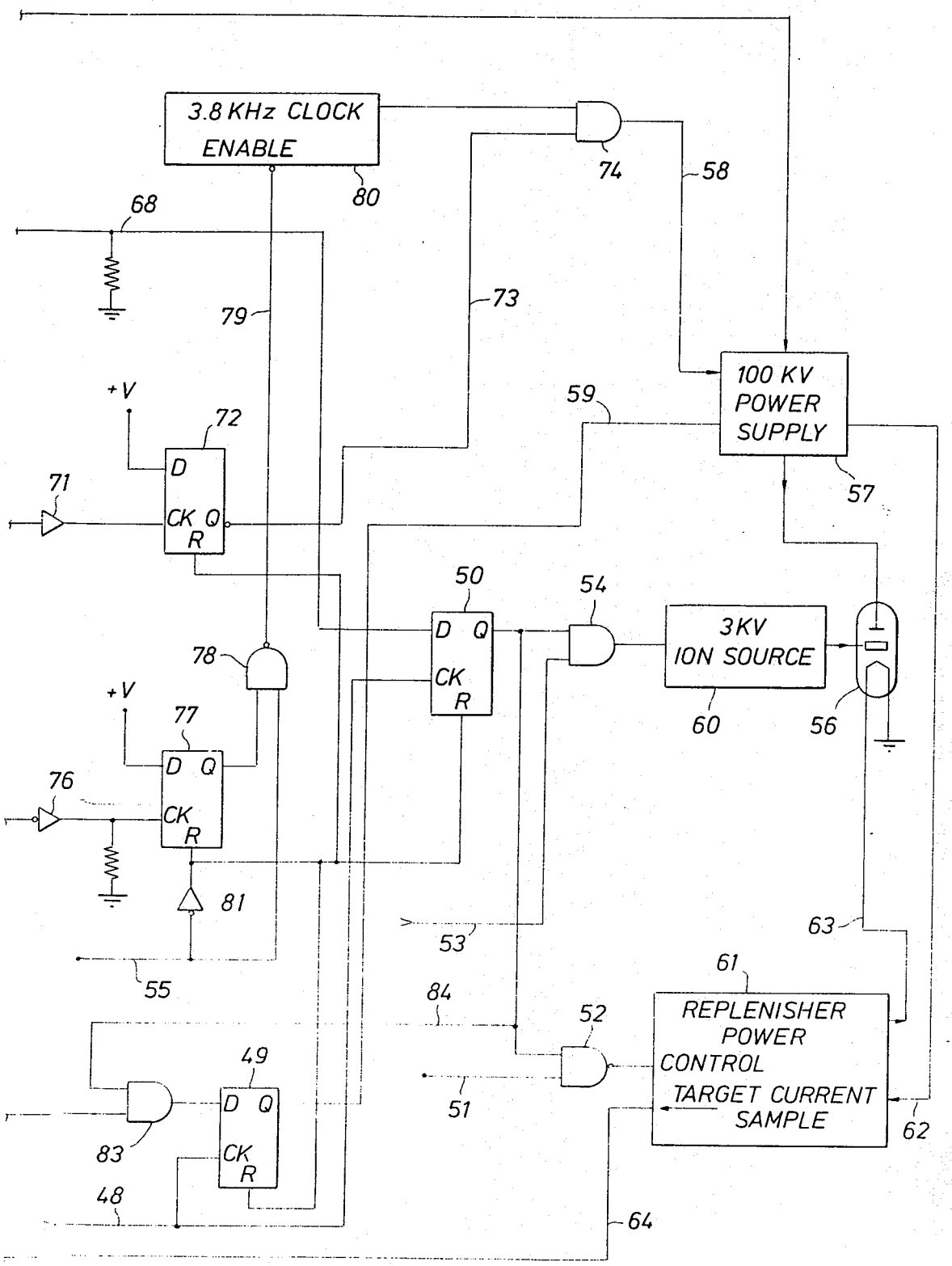

In FIG. 2 of the drawings, the pulsed neutron generator system is generally identified by the numeral 28. It is the equipment carried within the sonde 14. It is shown with a pair of input wires 32. The conductors 32 are the input from the logging cable 16, and they are input to a transformer 33. The transformer 33 connects to a full wave bridge formed of four diodes to form an output voltage on a conductor 34. The output voltage is typically around 50 volts. AC ripple is grounded through a capacitor 35. More will be noted concerning this circuitry hereinafter.

The power input conductors are also input to a sonde AC power supply 36. It forms a suitable B+ voltages for instrumentation with the sonde. In particular, it forms suitable levels for operation of the transistorized circuitry shown in FIG. 2. The input cables 32 are connected to another transformer 37. The transformer 37 is connected to another full wave bridge 38 at the output. This forms a suitable voltage level for operation of a field effect transistor 39. The DC voltage which is formed is approximately 50 volts in the preferred embodiment and is applied through a series load resistor 40 to the drain of the FET 39.

The sonde AC power supply 36 must obviously be on for the equipment to operate. An output is taken from it and is provided through a series dropping resistor 41 and a second resistor 42. The resistors 41 and 42 are serially connected at any convenient point in the AC power supply, typically near the output end thereof. The voltage may very well be AC or at least some large AC component will be included in the output voltage. Whatever the case, the adjustable resistor 42 includes a tap which is selectively located to obtain a portion of the applied voltage and is input to a rectifier 43. The rectifier forms a signal across a series dropping resistor 44 which is proportional to the sonde AC power supply. Not only does it indicate that the power supply is operative, but it also is proportional to thereby respond to severe drops in line voltage. It will be recalled that the lines 32 are subject to line drop, and testing for AC voltage regulation is therefore also implemented.

AC LINE SAMPLING

The sampled voltage which is applied to the resistor 44 serves as one input to a differential amplifier 45. This voltage is compared with a suitable voltage at the differential amplifier input typically provided from a B− supply cooperative with a Zener diode. The differential voltage is then applied to the gate of the FET 39, and a signal is developed across the output load resistor 47. This voltage level is proportional to the sonde AC power supply which is, in turn, dependent on line voltage applied to the pulsed neutron generator system 28. Should that voltage be within an acceptable range, the circuitry, to be described, responds to that range. On the other hand, should the voltage be outside of the specified range, this will be reflected by the voltage across the resistor 47.

AC SHUNT REGULATOR

As described to this juncture, the system includes an AC shunt regulator comprised of the transformer 37, the bridge 38, the FET 39 and the circuitry connected between them. Suitable design criteria envisions constructing this equipment to operate for a 400 hertz power input at 115 volts. A specified tolerance is permitted. Quite obviously, the voltage and frequency can be adjusted and the tolerance can also be modified. The AC shunt regulator, just described, is connected to the logging cable as a monitor. It is of some benefit to note that the transformer 37 across the lines 32. A change of the current level in the secondary of the transformer 37 is reflected in the primary by a change of current in the primary. The primary winding current is varied in such a manner by the load imposed by the transformer 37 to provide some regulation to the logging sonde primary AC voltage which is applied to the transformer 33 and the AC power supply 36. In other words, the load on the cable 32 is comprised of three parallel components, namely the primary of transformers 33 and 37 along with the sonde AC power supply 36. This helps stabilize the AC voltage at the end of the cable notwithstanding variations in load. The stabilization is achieved by means of the reflected impedance observed through the input terminals of the transformer 37.

Consider the normal operation of the equipment. Assume that the AC power source 26 in the logging truck is switched on and is adjusted to the AC voltage level for fully and adequately powering the sonde located equipment. When this first occurs, the pulsed neutron generator tube is typically in idle. Without the shunt regulator just described, the voltage applied to the power supplies, shown in FIG. 2, would be quite high, typically about 40% too high. However, the shunt regulator is scaled so that current begins to flow in the regulator circuitry as soon as the applied voltage rises about the desired level, typically 115 volts AC. As the sonde AC voltage continues to increase, the shunt regulator current increases and adequately loads the conductors to maintain a stabilized 115 volt level. When the AC voltage source, in the truck, is adjusted to the point where it provides adequate power to operate the pulsed neutron generator equipment shown in FIG. 2 at maximum current, the current in the secondary of the transformer 37 is again increased. The transformer 37 thus reflects a variable load into the line which is reduced when it is not required to operate the logging equipment. The shunt regulator swings in the direction opposite to the pulsed neutron generator tube created load, enabling adequate voltage and current to be furnished to the pulsed neutron generator tube and the circuitry associated with it.

This will be more readily understood on a development of the circuitry affiliated with the pulsed neutron generator tube.

CONTROL SIGNALS

In FIG. 2 of the drawings, the conductor 48 is input from a clock (not shown) which forms a one second clock pulses of sufficient amplitude. It is input to a flip-flop 49 which monitors the target current, and also to a flip-flop 50 which monitors the driver current. The signal on the conductor 48 is created by the clock subject to control from other sonde located equipment. Another input is provided on the conductor 51. This signal is high or positive (speaking of logic levels and not voltage levels) during the time interval in which the pulsed neutron generator is switched on, and is low during the time interval that background measurements are being made. The conductor 51 is connected through a NAND gate 52 and an output from the flip-flop 50 just mentioned.

Another input is on the conductor 53 and is an ion source control pulse. It too is under control from other equipment in sonde. A positive going or high signal is the signal of interest. It is applied over the conductor 53 to a NAND gate 54. The conductor 55 inputs the reset signal.

The input signals applied for controlling the circuitry 28 shown in FIG. 2 are thus obtained from the conductors 48, 51 53 and 55 just described and these signals may generally be described as timing control signals.

POWER SUPPLIES

A pulsed neutron generator tube 56 is shown in FIG. 2. It has certain cooperative circuitry of significance. For one, there is a high voltage power supply. Typically, it is rated at 100 KV. It is identified at 57. It must be provided with current on the conductor 34. A control signal is input on a conductor 58. Another control signal is input on a conductor 59, and both control signals will be described hereinafter.

The pulsed neutron generator tube 56 also requires a 3,000 volt pulse. This is obtained from a 3,000 volt ion source power supply 60. A replenisher power supply is included at 61. The power supply 61 is under control of a signal on a conductor 62 from the high voltage power supply 57. It forms a replenisher current applied through a conductor 63 to the pulsed neutron generator tube 56. Target current flows in the replenisher power supply 61 and an output signal is formed indicative of target current. This signal, in the form of a DC level, is applied over a conductor 64.

A typical turn-on sequence for the pulsed neutron generator tube involves the following requirements:

1. A nominal 50 volt DC level is required on the conductor 34 for the target high voltage power supply 57. A nominal rain of 50 is specified. Typical tolerances will enable it to operate in a range of about 35 to 55 volts.

2. A six microsecond pulse, at about 3,800 hertz, and a logic zero control voltage are both required for the target high voltage power supply 57.

3. When the target high voltage power supply reaches some specified value, minimum, a 3,000 volt ion source pulse is applied by the power supply 60.

4. Simultaneously with the last step, replenisher current for the pulsed neutron generator tube 56 is furnished by the power supply 61.

5. When the pulsed neutron generator tube starts generating neutrons, as evidenced by the target current, a logic one control voltage is applied to the target high voltage power supply 57. The power supply 57 increases its output to the nominal maximum rating of 100 kilovolts.

6. In the event of any malfunction, switch-off occurs, turning off the ion source pulses from the power supply 60, switching off the replenisher current of about two amperes from the supply 61 and the supply 57 is reduced from about 100 kilovolts output to about 70 kilovolts.

CONTROL SYSTEM

The AC shunt regulator has been described; the various control signals on the conductors 48, 51, 53 and 55 have been described; the pulsed neutron generator tube 56 and the power supplies affiliated with it have also been described. The control system and its interlocks will now be set forth. It involves the circuitry shown in FIG. 2 which includes the AC shunt regulator on the left, the various power supplies and pulsed neutron generator tube on the right, and the control circuitry in the center of FIG. 2. To this end, a current sensing resistor 66 is connected to the bridge shown in FIG. 2 and forms a level which is input to a differential amplifier 67. The other input terminal is connected to a bias source for the amplifier 67. As the current flow in the conductor 34 increases, a sample voltage is formed across the resistor 66. This voltage level varies dependent on the current load. Accordingly, driver current is sensed by the differential amplifier 67 which forms a logic zero on output on the conductor 68. This signal is applied to the flip-flop 50. The flip-flop 50 is clocked by the signal on the conductor 48; driver current in excess of a specified level is determined and a signal is formed by the driver current flip-flop 50 at the NAND gate 54. Assuming that driver current has increased above a required threshold, the signal formed on the conductor 68 is then communicated to the 3,000 volt ion source power supply 60.

The resistor 66 samples the voltage as described above for an additional differential amplifier 70. This differential amplifier functions with two inputs, the second being a bias voltage serving as a comparison point to determine driver current overload. The differential amplifier 67 determines driver current in excess of a specified minimum while the differential amplifier 70 detects an overload. In the event that an overload does occur, it forms an output which switches from a logic one to a zero, and this is inverted by an inverter 71, and is applied to an overload flip-flop 72. That forms a signal on a conductor 73 which is input to enable an AND gate 74. That is connected to the conductor 58 previously described to input a 3,800 hertz clock signal to the high voltage power supply 57.

Attention is next directed to a differential amplifier 75. This differential amplifier is provided with a comparison input voltage. It is contrasted with the input voltage from the resistor 47. The resistor 47, described earlier, provides an input level indicative of adequate voltage to the sonde AC power supply 36. Accordingly, the differential amplifier 75 switches from a logic one to zero when adequate AC voltage has been provided. The output is connected to an inverter 76. That, in turn, connects with a start generator flip-flop 77. The output is connected to a NAND gate 78 which switches from a logic one to zero output on a conductor 79. The conductor 79 is the enable signal for a 3,800 hertz clock generator 80. That has an output connected to the enable gate. This signal is provided over the conductor 58. The conductor 58 switches the high voltage power supply from approximately 70 kilovolt output to about 100 kilovolt output.

It will be observed that there are flip-flops 49, 50, 72 and 77; they are connected to a common reset line 55 previously mentioned.

The target current must be within a specified range. The conductor 64 delivers a signal proportional to target current. Again, this is input to a differential amplifier 82 and is compared by that amplifier with a set voltage from a bias resistor network. If the target current exceeds a specified level, typically 50 microamperes in the preferred embodiment, the output of the amplifier 82 switches from zero to one, and is input to an AND gate 83 which toggles the target current flip-flop 49. A conductor 84 provides a feedback signal from the driver current flip-flop 50. In turn, the target current flip-flop 49 forms an output on the conductor 59 which indicates that the target current is acceptable, and the signal on the conductor 59 therefore enables the high voltage power supply 57 to switch to 100 kilovolt output.

OPERATION

Normal operation of the circuitry 28 involves the application of outside control signals on the conductors 48, 51, 53 and 55. A logic zero is applied on the conductor 55. This resets the four flip-flops previously identified. On resetting, the pulsed neutron generator is switched off, and all the control circuitry is prepared for the turn-on sequence. As primary AC power is applied to the sonde on the lines 32, power on the unregulated conductor 34 is applied to the target high voltage driver circuit 57. The signal on the conductor 55 is switched to a logic one which enables the four flip-flops. Simultaneously, a one second clock pulse is applied on the conductor 48. The AC source voltage is tested to be sure that it is sufficiently high to operate the pulsed neutron generator tube and associated equipment. Assuming this is true, it is indicated by the voltage across the sampling resistor 47 which, in turn, is coupled through the differential amplifier 75 by forming the proper logic signal. That is applied to the flip-flop 77 which is the start generator flip-flop. This is indicative that the AC shunt regulator section of the apparatus has operated correctly to determine that the line voltage is within an adequate range. In other words, it is sufficiently high to power the equipment. It does not overpower the equipment and thereby avoids damaging the voltage sensitive equipment. These signals switch-on the 3,800 hertz clock 80 and cause it to form a pulse that is approximately six microseconds wide.

Looking now at the power supply 57, it is then furnished with the unregulated (35–55 volt) current for its operation, a 3,800 hertz clock pulse on the conductor 58, and the voltage level on the conductor 59 to enable switching the power supply 57 on. The target high voltage begins to increase slowly towards a designated idle mode voltage, typically about 70 kilovolts. As it increases, the current also increases. As this current increase occurs, it is sensed by the sampling resistor 66. In turn, the differential amplifier 67 senses this and forms a logic signal on the conductor 68 input to the flip-flop 50. Once the flip-flop 50 has been provided with that input signal, on the next occurrence of a one second clock signal from the line 48, the flip-flop 50 toggles to form a logic one. This enables the ion source power supply 60 so that the ion source pulses are then provided to the pulsed neutron generator tube 56.

When this latter event occurs, and assuming that an ion source control pulse is applied from the control system on the conductor 53 in timely fashion, the power supply 60 does operate. In conjunction with the enable signal on the conductor 51, the replenisher power supply 61 is also switched on. Target current is sampled as detected by the differential amplifier 82 which forms the logical output signal. This, coupled through the target current flip-flop 49, forms a control signal on the conductor 59. That signal switches from a logic zero to a logic one. This signal enables the high voltage supply 57 to switch to full output voltage or about 100 kilovolts.

MALFUNCTION DETECTION

The pulsed neutron generator tube 56 operates for a period of time. Target current is sampled. Target current is the current which flows in the conductor 64. It will be recalled that this target current flows from the power supply 57. A signal proportional to the target current is formed on the conductor 64 and input to the target current sampling differential amplifier 82. If the target current rises above a set level, typically 50 microamperes, this is indicative that it is operating correctly. In the event that it drops below 50 microamperes, this is detected by the differential amplifier 82 and it operates to form a signal reducing the target voltage from about 100 kilovolts to about 70 kilovolts, this voltage being an idle voltage.

An important factor is whether or not high voltage driver current is excessive. This is indicated by excessive current flow through the conductor 34. That, in turn, forms a signal at the sampling resistor 66 which is sensed or detected by the amplifier 70 operating the overload flip-flop 72. If such an overload does occur, the flip-flop 72 alters the enable signal on the conductor 73. If this occurs, the AND gate 74 operates through the conductor 58 to deprive the high voltage power supply 57 of the necessary 3,800 hertz clock pulses and thereby switches the power supply from full output to zero. In other words, the power supply 57 is switched off. This prevents damage to the circuitry as indicated by excessive current flow through the high voltage supply.

While the foregoing is directed to the preferred embodiment of the present invention, other and further embodiments of the invention may be devised without departing from the basic concept thereof, and the scope thereof is determined by the claims which follow.

I claim:

1. A system for protecting a neutron generator tube of the deuterium-tritium accelerator type and having a replenisher, an ion source and a target electrode, and AC power supplies for said replenisher and said ion source and a high voltage power supply for said target electrode, all carried inside a fluid tight hollow body member sized and adapted for passage through a well borehole and suspended in a well borehole on armored well logging cable having a plurality of electrical conductors for supplying power to said system and for carrying signals from said system to surface located equipment, comprising:

means for monitoring power supply voltages on conductors of the well logging cable and generating a cable conductor voltage signal representative thereof;

means for monitoring the target current in said generator tube and generating a target current signal representative thereof;

means for generating clock pulse signals at one second and 3800 hertz time intervals;

means for monitoring said AC power supplies for said replenisher and said ion source and for generating replenisher output signals and ion source output signals representative thereof; and means enabled by said clock pulse signals for comparing said cable conductor output signal, said target current output signal and said AC power supply output signals to representative standard value signal representations of these signals and, upon failing such comparison by any one of said signals against its respective standard, for shutting down operation of said neutron generator tube, thereby protecting said tube.

2. The system of claim 1 and further including a shunt regulator AC power supply and means for monitoring the output voltage of such shunt regulator supply and for supplying an output signal representative thereof.

3. The system of claim 2 and further including means for comparing said shunt regulator output signal with a standard representative signal of its value and means for disabling said AC power supplies in the event of failure of such comparison.

4. The system of claim 1 and further including high voltage power supply means including a high voltage driver for providing a high negative voltage of approximately 100 kilovolts to said target.

5. The system of claim 4 and further including means for monitoring the current output of said high voltage driver and generating a driver current output signal representative thereof.

6. The system of claim 5 and further including means for comparing said driver current output signal with a standard value signal for driver current and for shutting off said high voltage driver if said comparison fails.

* * * * *